US011498747B2

(12) United States Patent
Mekhitarian et al.

(10) Patent No.: US 11,498,747 B2
(45) Date of Patent: Nov. 15, 2022

(54) LINER DISPENSER

(71) Applicant: BOBRICK WASHROOM EQUIPMENT, INC., North Hollywood, CA (US)

(72) Inventors: Raffi Mekhitarian, Shadow Hills, CA (US); Brendan Whitehead, Englewood, CO (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

(21) Appl. No.: 16/737,861

(22) Filed: Jan. 8, 2020

(65) Prior Publication Data

US 2021/0206559 A1 Jul. 8, 2021

(51) Int. Cl.
*B65D 83/08* (2006.01)

(52) U.S. Cl.
CPC ..... *B65D 83/0817* (2013.01)

(58) Field of Classification Search
CPC ..... A47K 10/421; A47K 2010/3233; A47K 2010/3266; A47K 5/1204; B65D 83/0817; B67D 5/06
USPC ..... 221/45, 276; 220/478, 477; 222/153.03; 664/179
See application file for complete search history.

(56) References Cited

U.S. PATENT DOCUMENTS 626,085 A * 5/1899 Ormerod ..... A47K 5/10 222/165
1,441,410 A * 1/1923 Eustis ..... A47K 10/42 312/242
3,187,954 A * 6/1965 Hammer ..... A47K 5/1204 222/51
3,650,487 A * 3/1972 Bahnsen ..... A47K 10/38 242/560.3
4,880,145 A * 11/1989 McManus ..... A47K 3/281 4/597
5,131,561 A * 7/1992 Casperson ..... A47K 10/427 221/45
5,143,262 A * 9/1992 Edlund ..... A47K 5/06 222/164
5,183,182 A * 2/1993 Comstock ..... A47K 5/12 222/129
5,310,129 A * 5/1994 Whittington ..... A47K 10/3836 242/563.2
5,413,251 A * 5/1995 Adamson ..... A47K 5/1211 222/129
6,405,972 B1 * 6/2002 Wakam ..... A47K 10/3836 242/597.7
7,051,987 B2 * 5/2006 Chen ..... A47K 5/12 248/447.1
7,661,553 B2 * 2/2010 Zeiron ..... A47K 10/427 221/46
8,261,937 B2 * 9/2012 Bodziak ..... B65D 83/0817 221/45
8,887,960 B2 * 11/2014 Hardman ..... B67D 7/02 222/165
9,452,873 B2 * 9/2016 Eberlein ..... A45D 33/006
(Continued)

*Primary Examiner* — Rakesh Kumar
(74) *Attorney, Agent, or Firm* — Lewis Roca Rothgerber Christie LLP

(57) ABSTRACT

A dispenser includes a housing including an opening, a lid for covering the housing opening, a reservoir for holding items to be dispensed from the dispenser, and a dispensing opening on the lid providing access to the reservoir.

24 Claims, 6 Drawing Sheets

(56) References Cited

U.S. PATENT DOCUMENTS

| | | | | |
|---|---|---|---|---|
| 9,622,627 | B2 * | 4/2017 | Wilson | A47K 10/422 |
| 9,682,390 | B2 * | 6/2017 | Ophardt | A47K 5/12 |
| RE46,854 | E * | 5/2018 | Byeon | A45D 33/006 |
| 10,980,377 | B1 * | 4/2021 | Falk | A47K 10/422 |
| 2006/0086748 | A1 * | 4/2006 | Burns | A47K 10/426 221/48 |
| 2008/0011626 | A1 * | 1/2008 | Bodziak | F16B 47/00 206/829 |
| 2008/0061073 | A1 * | 3/2008 | Laroche | A47K 10/421 221/63 |
| 2009/0223992 | A1 * | 9/2009 | Lorenzati | A47K 10/421 221/34 |
| 2012/0118905 | A1 * | 5/2012 | Lindbergh | A47K 10/421 221/197 |
| 2014/0217112 | A1 * | 8/2014 | Young | A47K 10/422 221/45 |
| 2015/0048104 | A1 * | 2/2015 | Wilson | A47K 10/427 221/45 |
| 2017/0172359 | A1 * | 6/2017 | Roberts | A47K 10/185 |
| 2017/0202409 | A1 * | 7/2017 | Cahalan | A47K 10/421 |

* cited by examiner

LINER DISPENSER

BACKGROUND OF THE INVENTION

Dispenser for items such as liners for covering the beds of baby changing stations prior to use, or other sheet materials are popular in various establishment bathrooms. Many of these dispensers are not easy to replenish with the items and many have difficulties in allowing for the dispensing of such items when the number of items in the dispenser have been reduced. Thus, dispensers that are easier to load with the items to be dispensed and/or which allow for easier dispensing of items, even if when the numbers of items in the dispenser are reduced, are desired.

SUMMARY OF THE INVENTION

An example embodiment dispenser includes a housing including an opening, a lid for covering the housing opening, a reservoir for holding items to be dispensed from the dispenser, the reservoir being formed on the lid for being in the housing when the lid covers the housing opening, and a dispensing opening on the lid providing access to the reservoir. In another example embodiment, the lid rotates relative to the housing opening from a closed position covering the housing opening to an open position exposing the housing opening. In yet another example embodiment, the dispenser further includes a stop for stopping the rotation of the lid relative to the housing at an angle in the range of 30 degrees to 70 degrees. In one example embodiment, the angle is 60 degrees. In an example embodiment, a stop member extends from the lid and penetrates a housing wall, the stop member engaging the housing for stopping the rotation of the lid relative to the housing. In a further example embodiment, the housing defines a trough for receiving a lower end portion of the lid when the lid is in the open position, where the slot penetrates the wall by penetrating a slot formed on a wall of the housing defining the trough. In yet a further example embodiment, the reservoir defines an inlet opening for receiving the items. In another example embodiment, when in the lid is in the closed position the inlet opening is defined on top of the reservoir. In one example embodiment, the reservoir includes a wall spaced apart from the lid, and the inlet opening is between the lid and the rear wall. In another example embodiment, the lid rotates about an axis, the reservoir includes a bottom wall extending between the lid and rear wall, and two opposite sidewalls extending between the lid and the rear wall and extending from the bottom in a direction away from the axis to the inlet opening. In yet another example embodiment, the dispenser also includes spring member extending from the rear wall for exerting a force on the items to be dispensed. In example embodiment, the dispensing opening has a boundary having an upper end opposite a lower end, and the spring member extends to a location between the upper end and the lower end for exerting a force for pushing the items toward the dispensing opening. In a further example embodiment, the dispenser also includes a depression on the lid adjacent the dispensing opening allowing for easier access to the items to be dispensed through the dispensing opening. In yet a further example embodiment, the lid is completely removable from the housing. In one example embodiment, an inner surface of the lid defines an inner surface of the reservoir. In another example embodiment, the reservoir is separate from the lid and is coupled to the lid and wherein the lid defines a wall of the reservoir. In yet another example embodiment, the reservoir further includes a second reservoir for holding items to be dispensed from the dispenser, the second reservoir being formed on the lid for being in the housing when the lid covers the housing opening, and a second dispensing opening on the lid providing access to the second reservoir. In a further example embodiment, the dispenser is part of a baby changing station.

DETAILED DESCRIPTION

As example embodiment dispenser may be used or adapted to dispense individual sheets, or sheet-like, or flat materials, such as for example liners, diapers, or towels and the like. For illustrative purposes only, example embodiment of a dispenser for dispensing liners are described herein. More specifically, a dispenser for dispensing liners such as liners used to cover a bed of a baby changing station is described herein. While example embodiment dispensers may be used independently, example embodiment dispensers are described herein for use with a baby changing station or as part of a baby changing station.

Figure 1:
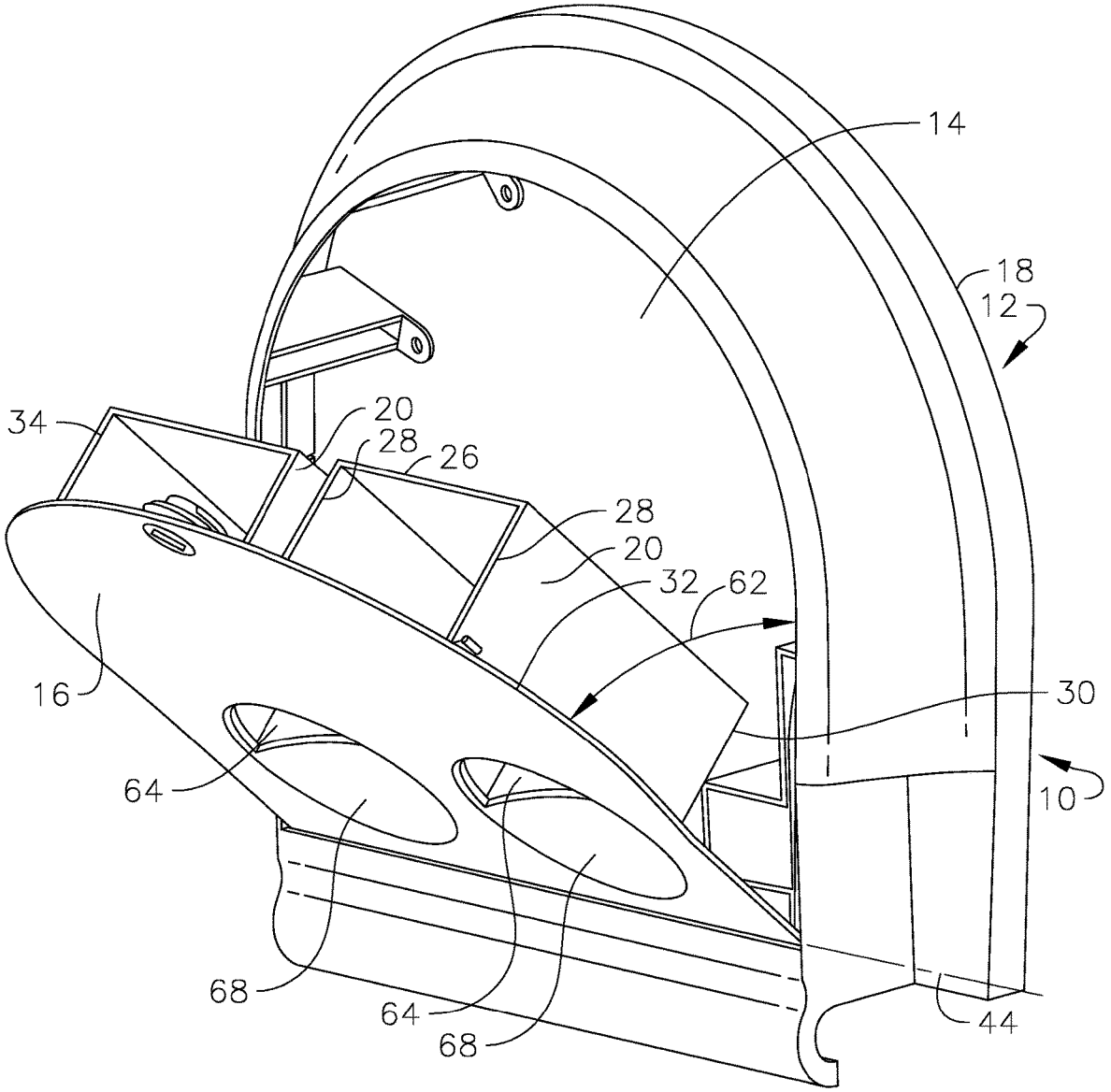
FIG. 1 is a perspective view of an example embodiment dispenser.
Figure 7:
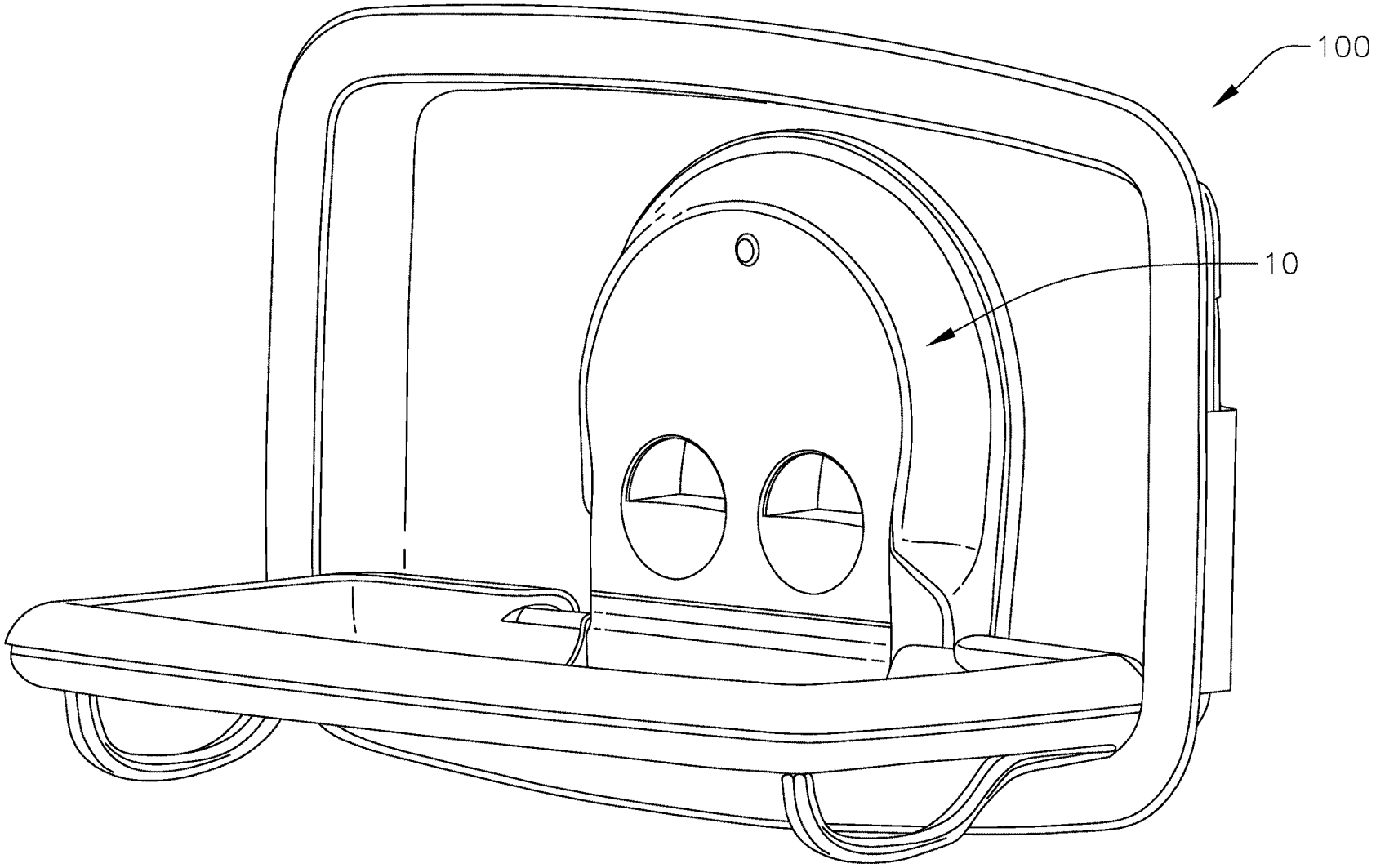
FIG. 7 is a perspective view of the dispenser shown in FIG. 1 mounted on a baby changing station.

An example embodiment dispenser 10 as shown in FIG. 1, is designed for being mounted within a baby changing station 100 wall mount section as for example shown in FIG. 7. However, in other example embodiments, it is not mounted within a baby changing station. The example embodiment dispenser includes a housing 12 defining an opening 14. The opening is covered by a lid 16 that may be rotatable from a closed position covering the opening 14 to an open position as for example shown in FIG. 1. The lid may be removable from the housing. The housing may have an open rear 18 opposite the lid, as for example shown in FIG. 1. When mounted against a wall or other structure, as for example, a baby changing station, the wall or other structure will cover the open rear forming a rear wall for the housing. The dispenser includes at least one reservoir 20 for holding the items (e.g., the liners in this case) to be dispensed. In the shown example embodiment, the dispenser includes two reservoirs. The reservoirs are mounted on a rear surface 22 of the lid 14, as for example shown in FIGS. 2 and 3. Each reservoir includes a rear wall 26, opposite side walls 28 and a base or bottom wall 30. In the example embodiments a front wall 32 of each reservoir is defined by the lid, e.g., rear surface 22 of the lid. In another example embodiment, a reservoir may include a separate front wall that is adjacent the rear surface of the lid. Each side wall 28 and the bottom wall 30 extend between the front wall 32 and the rear wall 26 of the reservoir. An inlet or filling opening 34 is defined by the side walls 28, the rear wall 26 and the front wall 32 for receiving the items to be dispensed. The reservoirs may be integrally formed with the lid. In the shown example embodiment, the reservoirs are separately formed and then are connected to the lid. The connection can occur for example by incorporating tabs 36 extending from the sidewalls 28 and including openings 38 for receiving projections 40 extending from the rear surface 22 of the lid, as for example shown in FIGS. 2 and 3. The projections may include detents 41 such that in combination with the tabs and their corresponding openings they define "snap" features such that the reservoir can connect with the lid. Other known methods of connecting the reservoirs to the lid may also be used. In an example embodiment, each reservoir may be removably connected to the lid, allowing for the removal of such reservoir.

Figure 2:
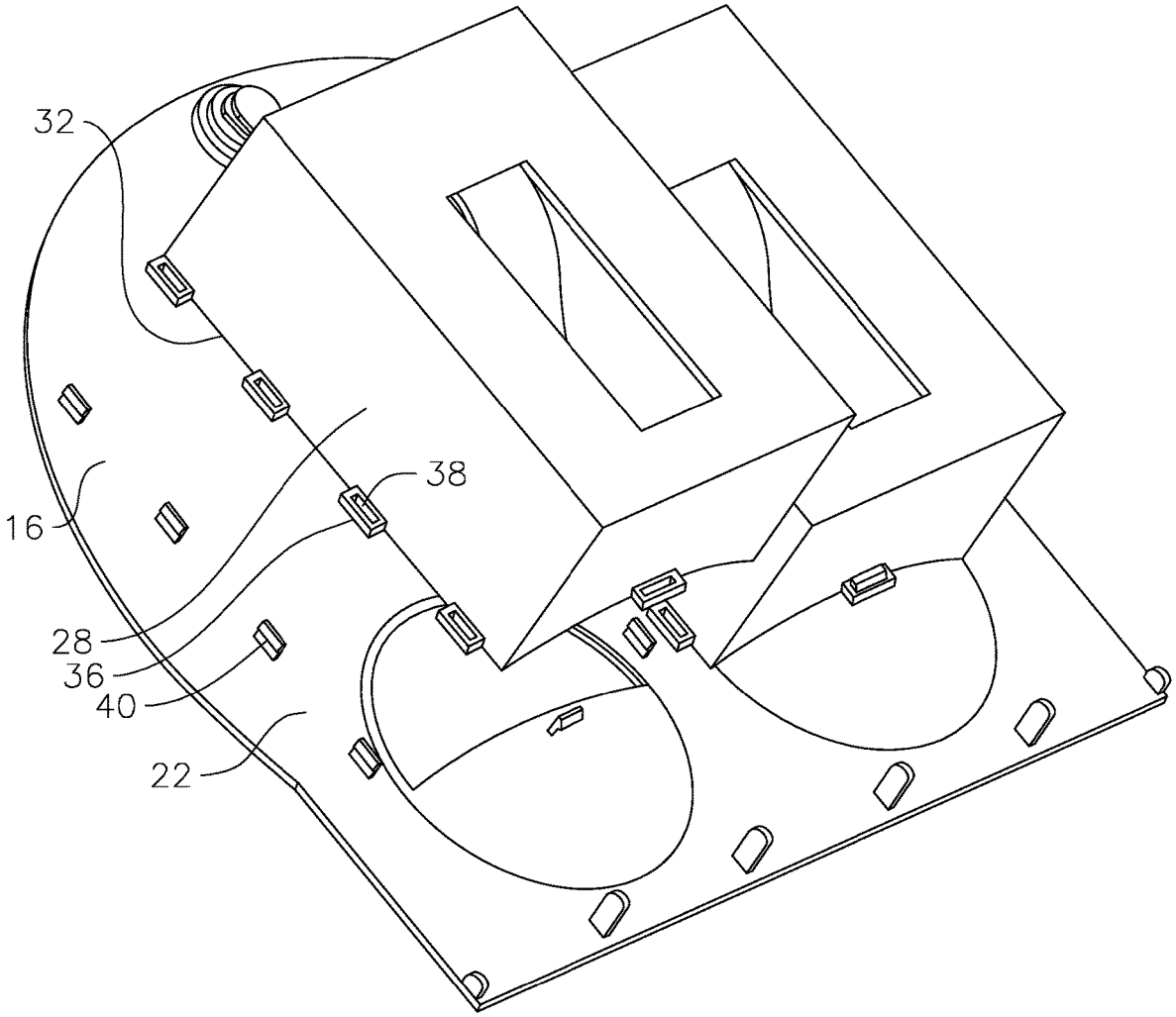
FIG. 2 is a partial exploded rear perspective view of a lid incorporated on the example embodiment dispenser shown in FIG. 1.
Figure 3:
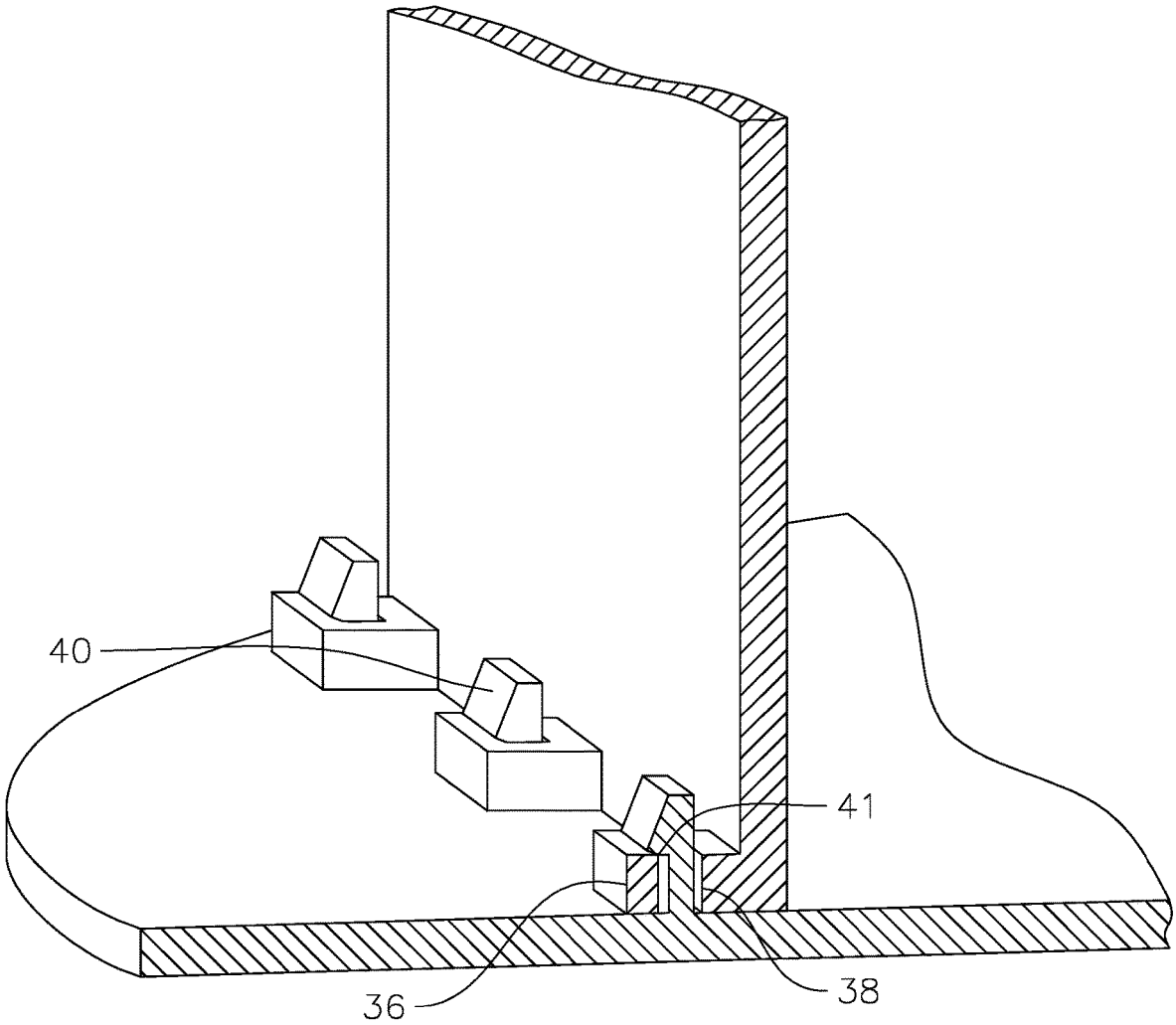
FIG. 3. is a partial sectional view of a reservoir being connected to lid of the example embodiment dispenser shown in FIG. 1.
Figure 4:
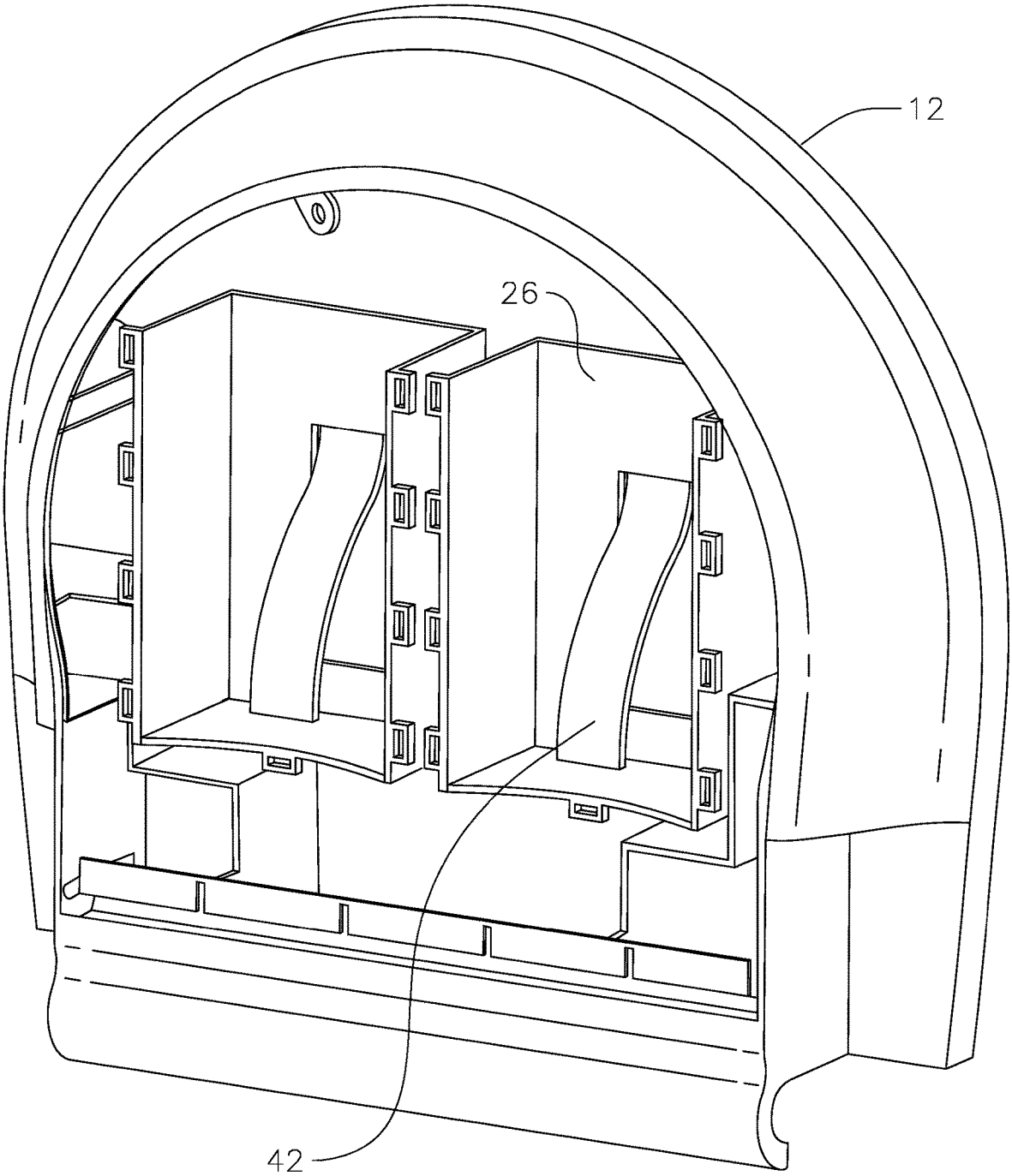
FIG. 4. is a front perspective view of the example embodiment dispenser shown in FIG. 1 without a lid.

In the shown example embodiment, a spring member, as for example a spring tab 42 extends from the rear wall 26 for exerting a force against the items to be dispensed in a direction toward the front wall (FIGS. 2 and 4). In an example embodiment, the spring member may be a separate member that is attached to the reservoir. In the shown example embodiment, the spring member 42 is integrally formed on the rear wall 26 of the reservoir, or may be part of the rear wall.

Figure 5:
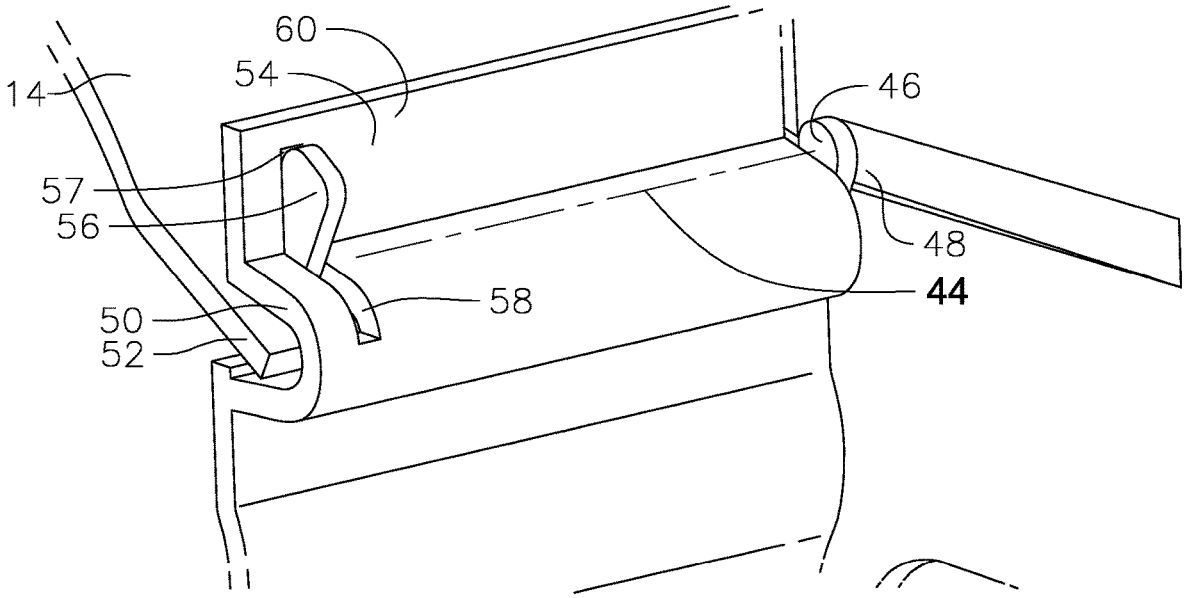
FIG. 5 is a partial rear perspective view of the lid being connected to the housing of the example embodiment dispenser shown in FIG. 1.

In the shown example embodiment, the lid 14 rotates (i.e., pivots) relative to the housing 12 about an axis 44, as for example shown in FIG. 1. In the shown example embodiment, projections 46 extend axially along the axis from opposite sides of the lid, as for example shown in FIG. 5. These projections are received in corresponding depressions 48 on the housing. In another example embodiment, the projections are formed on the housing and the corresponding depressions are formed on the lid. In an example embodiment, the projections and corresponding depressions are designed to allow the projections to snap is place into the depression and thus, allow the lid to snap connect with the housing. In another example embodiment, the projections are removable from their corresponding depressions, thereby allowing the lid to be completely removed from the housing. The lid rotates relative to the housing about these projections.

In an example embodiment a trough 50 is formed on the housing for receiving a lower end portion 52 of the lid 14 as the lid rotate to the open position relative to the housing about axis 44. The lower portion of the housing extends below the axis 44. A section 54 of the housing extends above the trough 50. Projections 56 extend transversely from the end portion 52 of the lid 14 to define stops 57, which penetrate corresponding slots 58 formed through the housing section defining the trough 50 for engaging the section 54 of the housing above the trough. The section 54 of the housing above the trough also defines a stop surface 60 that is engaged by the stops 57 for stopping the rotation of the lid about the axis 44 relative to the housing a position defining an angle 62 (FIG. 1). In an example embodiment the angle 62 the lid rotates to relative to a horizontal surface when it comes to a stop is in the range of 30 to 70 degrees. In another example embodiment this angle is about 60 degrees. Applicants have discovered that rotation of the lid to this angle when in the open position allows for easy in replenishing the items to be dispensed. Also, when the lid is open at angle 62, gravity retains the liners within the reservoir, preventing them from falling off the reservoir. Other well knows stops or stopping means may be used to stop the rotation of the lid relative to the housing at the desired angle 62.

Figure 6:
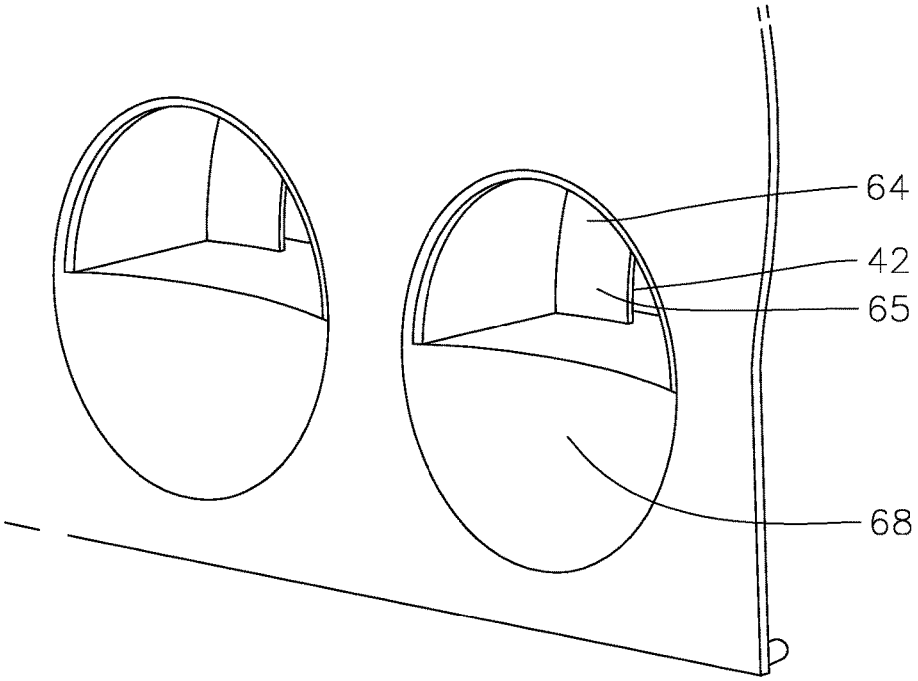
FIG. 6 is a partial front perspective view of the lid incorporated in the example embodiment dispenser shown in FIG. 1.

A dispensing opening 64 is formed through the front wall of each reservoir (or the front wall of the lid, for each reservoir) allowing for the dispensing of the liners housed in the reservoirs through such dispensing openings. In an example embodiment, a depression 68 (FIGS. 1 and 6) is defined on the outer surface of the front wall of the lid immediately below each dispensing opening to allow for a user to more easily access and obtain a liner housed in the reservoirs. To better assist with such dispensing, a portion 65 each spring member 42 extends to a location level below an upper end of the its corresponding dispensing opening and above its corresponding depression 68, as for example shown in FIG. 6. In this regard, the spring members exert a force against the items to be dispensed forcing a portion of such items towards or through the dispensing opening.

In the shown example embodiment, the dispenser (i.e., the housing and the lid) are injection molded from polypropylene. In other example embodiment the dispenser may be made from other materials, such as for example metals, composites, other plastics, etc.

While the description herein has been made in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "vertical," "horizontal," and similar terms may have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Moreover, the tasks described above may be performed in the order described or in any other suitable sequence. Additionally, the methods described above are not limited to the tasks described. Instead, for each embodiment, one or more of the tasks described above may be absent and/or additional tasks may be performed. Furthermore, as used herein, when a component is referred to as being "on" another component, it can be directly on the other component or components may also be present there between. Moreover, when a component is referred to as being "coupled" to another component, it can be directly attached to the other component or intervening components may be present there between.

The invention claimed is:

1. A dispenser comprising:

a housing comprising a housing opening;

a lid for covering the housing opening;

a reservoir for holding items to be dispensed from the dispenser and for being received in the housing through a portion of the housing opening, said reservoir being formed on the lid for being received in the housing when the lid covers said housing opening, wherein said reservoir comprises a rear wall moveable with the lid and spaced apart from the lid defining an inlet opening between the lid and said rear wall for receiving said items to be dispensed, wherein the lid is rotatable relative to the housing from a closed position covering said housing opening to an open position providing access to the inlet opening allowing for receiving said items to be dispensed in said reservoir, wherein a portion of the housing below said portion of the housing opening defines a wall having a front surface facing toward the lid and a rear surface opposite the front surface, wherein said rear surface retains the lid when the lid is in the open position; and a dispensing opening on the lid providing access to the reservoir.

2. The dispenser of claim 1, further comprising a stop for stopping the rotation of the lid relative to the housing at an angle in the range of 30 degrees to 70 degrees.

3. The dispenser of claim 2, wherein said angle is 60 degrees.

4. The dispenser of claim 1, wherein the reservoir comprises a bottom wall extending between the lid and rear wall, and two opposite sidewalls extending between the lid and the rear wall and extending from the bottom in a direction toward said inlet opening.

5. The dispenser of claim 4, further comprising a spring member extending from said rear wall for exerting a force on the items to be dispensed.

6. The dispenser of claim 5, wherein the dispensing opening has a boundary having an upper end opposite a lower end, and wherein the spring member extends to a location between the upper end and the lower end for exerting a force for pushing said items toward said dispensing opening.

7. The dispenser of claim 1, further comprising a depression on the lid adjacent the dispensing opening allowing for easier access to the items to be dispensed through the dispensing opening.

8. The dispenser of claim 1, wherein the lid is completely removable from said housing.

9. The dispenser of claim 1, wherein an inner surface of the lid defines an inner surface of the reservoir.

10. The dispenser of claim 1, further comprising:

a second reservoir for holding items to be dispensed from the dispenser, said second reservoir being formed on the lid for being received in the housing when the lid covers said housing opening; and a second dispensing opening on the lid providing access to the second reservoir.

11. The dispenser of claim 1, wherein said dispenser is coupled to a baby changing station.

12. The dispenser of claim 1, wherein the portion of the housing below the housing opening engages the portion of the lid below said reservoir when the lid is in the open position for retaining the lid in the open position.

13. The dispenser of claim 1, wherein the reservoir is separate from the lid and is coupled to the lid and wherein the lid defines a wall of the reservoir.

14. A dispenser comprising:

a housing comprising a housing opening;

a lid for covering the housing opening;

a reservoir for holding items to be dispensed from the dispenser, said reservoir being formed on the lid for being received in the housing when the lid covers said housing opening, wherein said reservoir comprises a rear wall moveable with the lid and spaced apart from the lid defining an inlet opening between the lid and said rear wall for receiving said items to be dispensed, wherein the lid is rotatable relative to the housing from a closed position covering said housing opening to an open position providing access to the inlet opening allowing for receiving said items to be dispensed in said reservoir; and a dispensing opening on the lid providing access to the reservoir, wherein a stop member extends from the lid and penetrates a housing wall, said stop member engaging the housing for stopping the rotation of the lid relative to the housing, wherein the housing wall defines a trough for receiving a lower edge of the lid when the lid is in the open position, and wherein said stop penetrates said housing wall by penetrating a slot formed through said trough.

15. The dispenser of claim 1, wherein when the lid is in the closed position the inlet opening is defined on top of said reservoir.

16. The dispenser of claim 14, wherein the lid rotates relative to the housing about an axis, and wherein said trough is below said axis when the lid is in the closed position.

17. The dispenser of claim 14, wherein the housing retains the lid in the open position.

18. A dispenser comprising:

a housing comprising a housing opening;

a lid for covering the housing opening, wherein the lid rotates relative to the housing opening from a closed position covering said housing opening to an open position exposing said housing opening;

a reservoir for holding items to be dispensed from the dispenser and for being received in the housing through a portion of the housing opening, said reservoir being formed on the lid for being received in the housing when the lid covers said housing opening; and a dispensing opening on the lid providing access to the reservoir, wherein the housing defines a trough entirely below said portion of the housing opening, wherein a lower edge of the lid is received within said trough when the lid is in the open position and is retracted from said trough when the lid is in the closed position.

19. The dispenser of claim 18, wherein the lid rotates relative to the housing about an axis, and wherein said trough is below said axis when the lid is in the closed position.

20. The dispenser of claim 18, wherein a stop member extends from the lid and penetrates a wall of the housing defining said trough, and wherein said stop member engages the housing for stopping the rotation of the lid relative to the housing.

21. The dispenser of claim 20, wherein the lid rotates relative to the housing about an axis, and wherein said trough is below said axis when the lid is in the closed position.

22. The dispenser of claim 18, wherein a portion of the lid below the reservoir engages said trough when said lid is in the open position for retaining the lid in the open position.

23. A dispenser comprising:

a housing comprising a housing opening;

a lid for covering the housing opening;

a reservoir for holding items to be dispensed from the dispenser, said reservoir being formed on the lid for being received in the housing when the lid covers said housing opening, wherein said reservoir comprises a rear wall moveable with the lid and spaced apart from the lid defining an inlet opening between the lid and said rear wall for receiving said items to be dispensed, wherein the lid is rotatable about an axis, wherein the reservoir comprises a bottom wall extending between the lid and rear wall, and two opposite sidewalls extending between the lid and the rear wall and extending from the bottom in a direction away from said axis to said inlet opening;

a dispensing opening on the lid providing access to the reservoir; and a spring member extending from said rear wall for exerting a force on the items to be dispensed.

24. The dispenser of claim 23, wherein the housing retains the lid in the open position.

* * * * *